US007429933B2

(12) United States Patent
Brennan et al.

(10) Patent No.: US 7,429,933 B2
(45) Date of Patent: Sep. 30, 2008

(54) BRACKET SYSTEM AND METHOD FOR USE WITH REMOTE-READING WATER METERS

(76) Inventors: Michael T. Brennan, P.O. Box 2110, 110 Dry Creek Rd., Healdsburg, CA (US) 95448; Jeffrey A. Cook, P.O. Box 2110, 110 Dry Creek Rd., Healdsburg, CA (US) 95448

( * ) Notice: Subject to any disclaimer, the term of this patent is extended or adjusted under 35 U.S.C. 154(b) by 1148 days.

(21) Appl. No.: 10/404,034

(22) Filed: Apr. 2, 2003

(65) Prior Publication Data

US 2004/0196159 A1 Oct. 7, 2004

(51) Int. Cl.
*G08B 23/00* (2006.01)

(52) U.S. Cl. ..... 340/870.07; 343/719; 343/770

(58) Field of Classification Search ..... 343/770, 343/719; 340/870.07; 73/201
See application file for complete search history.

(56) References Cited

U.S. PATENT DOCUMENTS 4,230,234 A * 10/1980 Taylor ..... 220/484
5,621,419 A * 4/1997 Meek et al. ..... 343/770
6,218,995 B1 * 4/2001 Higgins et al. ..... 343/719
6,300,907 B1 * 10/2001 Lazar et al. ..... 343/700 MS
2005/0059365 A1 * 3/2005 Higgins et al. ..... 455/128

* cited by examiner

*Primary Examiner*—Timothy Edwards, Jr.
(74) *Attorney, Agent, or Firm*—Craig M. Stainbrook; Stainbrook & Stainbrook, LLP

(57) ABSTRACT

A bracket and method for use in mounting a transducer/antenna unit in an underground meter box of the type which contains a remote-reading water meter. The box has a peripheral ledge defining an access opening that seats a lid. The bracket comprises a pair of beams which are spaced-apart sufficient to enable the installation and support of a cap containing the antenna. A pair of right angles on the beam ends are seated between the ledge and lid to suspend the beam and therefore the antenna at a predetermined height below the lid. The height is sufficient for holding the antenna at a position which is optimum for radiating RF signals for pick up by an above-ground remote receiver.

10 Claims, 4 Drawing Sheets

BRACKET SYSTEM AND METHOD FOR USE WITH REMOTE-READING WATER METERS

BACKGROUND OF THE INVENTION

1. Field of the Invention

The field of this invention relates to remote-reading water meters, and more particularly relates to the mounting of an antenna/transponder unit within a meter box.

2. Description of the Related Art

A conventional remote-reading water meter has an antenna/transponder unit which is installed in a meter box through the box lid, attached to the lid, or below the lid. Typically the meter box is buried in a pit below ground level. After a quantity of water flows through the meter, water consumption data is transmitted by radio frequency (RF) signals generated by the antenna/transponder. Registers in the meters have an encoder that works on a shaft that rotates as water passes through. The registers generate a signal that is transmitted to the antenna/transponder which advances the human-readable meter dials in a well-known manner and stores the data in the antenna/transponder's electronic memory cache. The remote receiver can be periodically actuated to send out a coded signal that turns on a transmitter in the transponder of a nearby meter. The transponder responds to the coded signal by generating the RF signals that contain the stored data.

The antenna of a conventional remote-reading meter is directional and radiates the RF signals in a relatively narrow beam. The beam is directed at an upward angle from a horizontal plane. The angle is selected to be optimum for transmitting RF signals to any nearby above-ground receiver that can pick up the signals. In certain areas a human meter reader carries a hand-held receiver that picks up the RF signals for recording the data from individual meters. Other areas can use mobile receivers in vehicles that are driven along roads in proximity to the meters for automatic pick up of the signals, and others utilize a fixed base receiving unit that receives the transmissions from the pit.

In typical remote-reading water meters, the meter box contains a hollow tube of plastic material, such as PVC, which is mounted vertically to house the antenna/transponder. Should the meter box become flooded with water, the antenna/transponder can float to the top and exit the tube's upper end. Then after the water recedes, the antenna/transponder can float down with the water outside the pipe and come to rest on its side on the pit floor. This can result in the remote receiver being unable to pick up the RF signals because, with the antenna/transponder on its side, the beam would no longer be transmitted at the optimum angle from the horizontal and thus not reach the receiver. The remote receiving capability of the meter would then be lost, causing a disruption in collecting the data. Other common fixtures include the drilling of holes in the meter box lid, attaching the antenna to the bottom of the lid, or attaching the antenna to a piece of PVC pipe or rebar which is driven into the ground.

In addition, there exist arrangements that incorporate the antenna into the box lid. But this can lead to antenna damage or wire lead damage. Thus, when the lid is removed for servicing and then dragged across a sidewalk or street the antenna can be damaged as a result of its location at the bottom of the lid.

OBJECTS OF THE INVENTION

It is an object of this invention to provide a new and improved system and method for mounting an antenna/transponder with a remote-reading water meter inside a meter box.

Another object is to provide a bracket system and method for use in a meter of the type described in which the antenna/transponder is mounted near the top of the meter box at a position that is optimum for radiating RF signals along a beam to an above-ground receiver.

Another object is to provide a bracket system and method for use with water meters of the type described in which the, antenna/transponders are held in a manner preventing any water flooding within the meter box from disabling proper transmission of the RF signal.

Another object is to provide a bracket system and method for use with water meters of the type described in which the antenna/transponders can be easily installed or removed without the use of tools.

Another object is to provide a bracket system and method for use in mounting antenna/transponders with water meters of the type described which is inexpensive and simple to manufacture.

DESCRIPTION OF THE PREFERRED EMBODIMENTS

Figure 1:
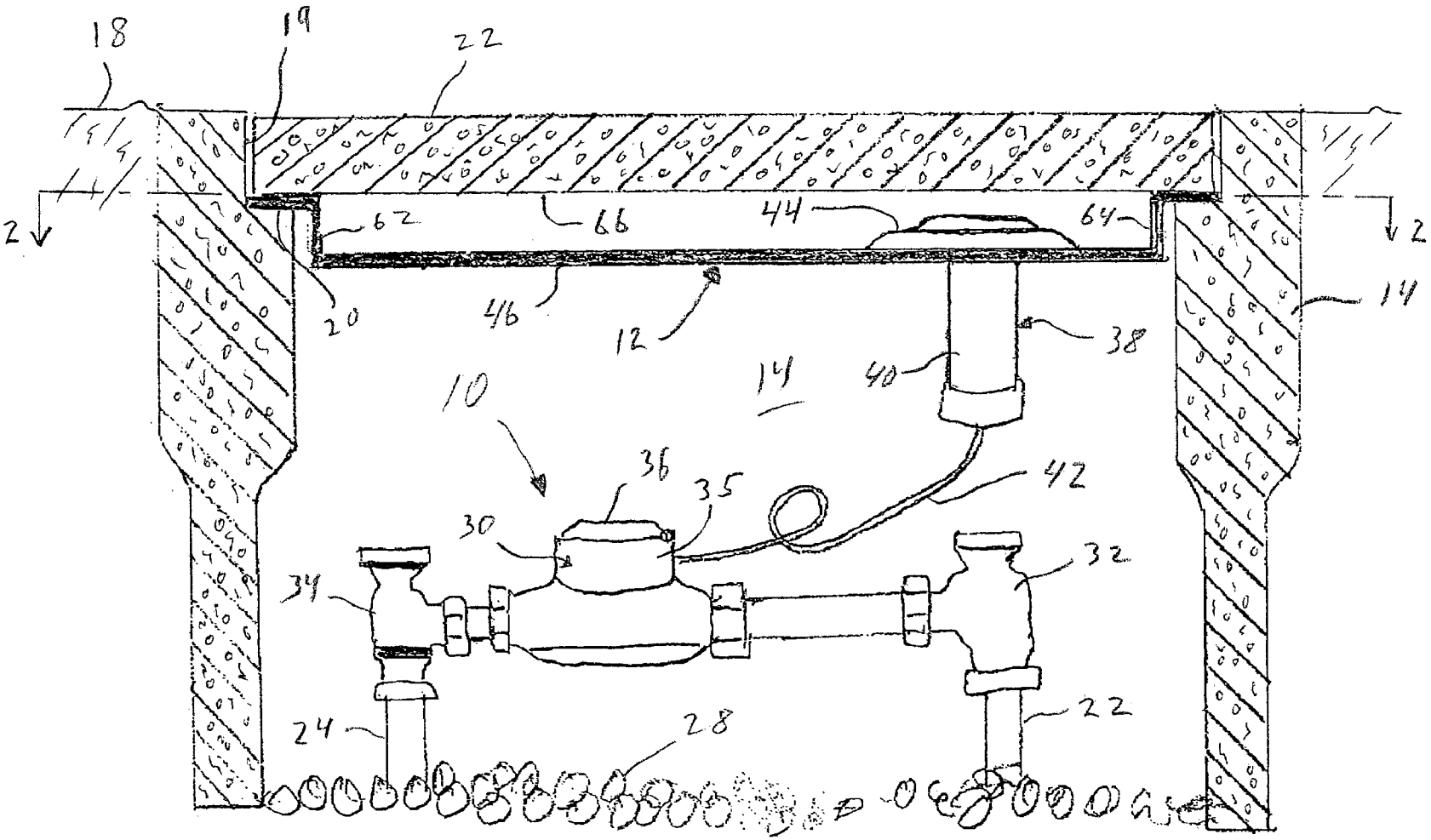
FIG. 1 is a side elevational view in cross section of a remote-reading water meter in a meter box shown with a bracket system incorporating a preferred embodiment of the invention.

In the drawings FIG. 1 illustrates generally at 10 a remote-reading water meter assembly incorporating a bracket system 12 in accordance with one embodiment of the invention.

The water meter assembly is mounted within an underground vault or pit 14. The pit is formed by a rectangular wall 16 which alternately could be cylindrical and is typically of concrete, plastic or plastic concrete composite, that is installed below ground level 18. The upper end of the wall has an access opening which is formed about its perimeter by a right angle notch 19 having an inwardly facing flat ledge 20. This ledge supports a lid 22, which can also be of concrete. The lid is removable to enable access by a worker into the pit.

Water meter assembly 10 is connected with inlet and outlet water pipes 24 and 26 which emerge upwardly from the pit floor that is shown as having a gravel layer 28. These pipes connect the water pipes of the building being served with the water utility's water mains. Assembly 10 is comprised of a remote-reading water meter 30, which can be of the type described in the Description of The Related Art section above. Meter 30 is connected between the inlet/outlet pipes by angle stops 32 and 34. The meter has a metal or plastic body 35 which houses a water consumption register (not shown), the dials of which face upwardly. If required, these dials can be exposed for manual reading when the worker pivots up a lid 36.

An antenna/transponder unit 38, which can be of the type also described above in the Description of The Related Art section, is provide as a component of the remote reading meter. The antenna/transponder unit comprises a cylindrical shell 40, which could be square of rectangular in cross section, for housing the electronic circuit components (not shown). The circuit is coupled with the meter body and register by an insulated cable 42 which transmits electric pulses from an optical scan, or other electronic signal generating devices (also not shown), in the meter that are generated as water is consumed. Unit 38 is mounted at the upper end of shell 40 for housing an antenna (not shown) of the type that radiates RF signals in a directional or omnidirectional beam. The unit 38 may comprise a circular flat cap 44, or it could simply be circular with the same diameter as that of shell 40, or it could be of rectangular or square cross section.

Bracket system 12 is adapted for retrofit into the pit of an existing remote-reading water meter assembly for holding its antenna/transponder unit at a position, shown in FIG. 1, which gives optimum RF signal transmission and which maintains and secures that position indefinitely.

Bracket 12 is comprised of a pair of elongated beams 46 and 48 which are held in parallel spaced-apart position by cross braces 50 and 52. The beams and braces can advantageously be made of stainless steel for strength and corrosion resistance, or they could be made of any other material that is suitable in a water pit environment. For stainless steel, zinc coated, epoxy or plastic the beams and braces can be spot welded or molded together. For some applications a single beam configured for holding the antenna/transponder at a desired position may be all that is necessary, and for multiple service installations, a multiple set of beams may be used.

The opposite ends of the beams are provided with suspension structures comprising right angles 54 and 56 which are shown as preformed as parts of the beams. As desired, the angle portions could be separate pieces secured to the beam ends. The angles comprise outwardly extending horizontally flat plates 58 and 60 and respective upwardly extending plates 62 and 64. The outwardly extending plates 58 and 60 have their outer ends spaced-apart commensurate with the distance between the vertical sides of notch 19. This enables the horizontal plates to removably seat on and be supported by ledge 20.

Figure 2:
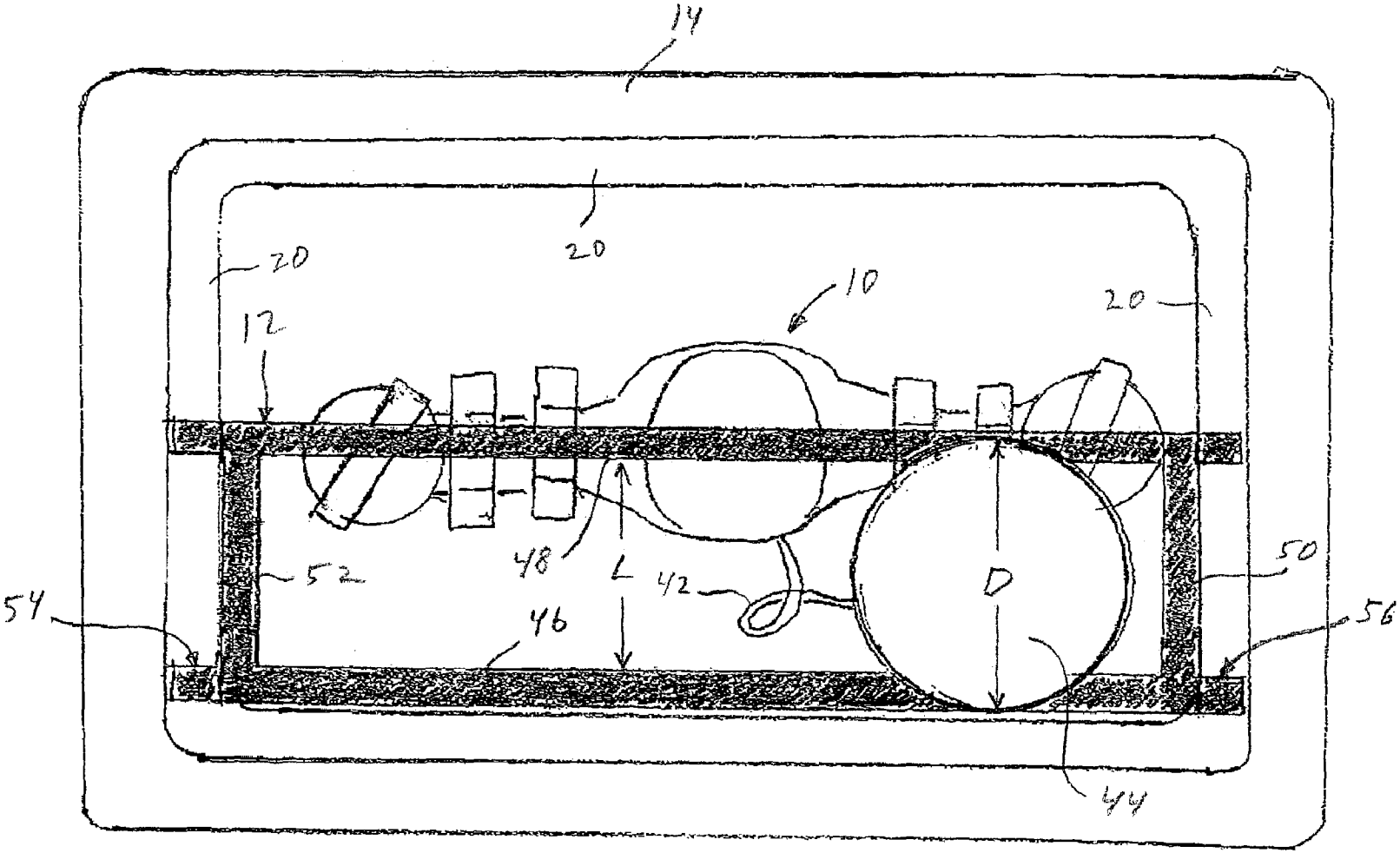
FIG. 2 is a horizontal cross section view taken along the line 2-2 of FIG. 1.

The lateral space length L between the facing sides of the beams (FIG. 2) is sufficiently less than the diameter D of antenna/transponder cap 44 so that the upper surfaces of the two beams provide adequate support for the antenna/transponder unit. The distance L must also be sufficiently large to enable in situ fitting of the antenna/transponder unit between the beams. This would be accomplished by manually tilting the unit at an angle from horizontal as it is moved up from below the bracket. With cap 44 tilted it can enter the space between the two beams and then be tilted back to horizontal for coming to rest with opposite diametral edges of the cap seated on top of the beams. Where the beams are made of a metal or other electrical conducting material, an insulating gasket, not shown, is fitted between the top of the beams and the cap edges, or a spacer could be fitted to the antenna/transponder via threads, clamping or other suitable fasteners.

Figure 3:
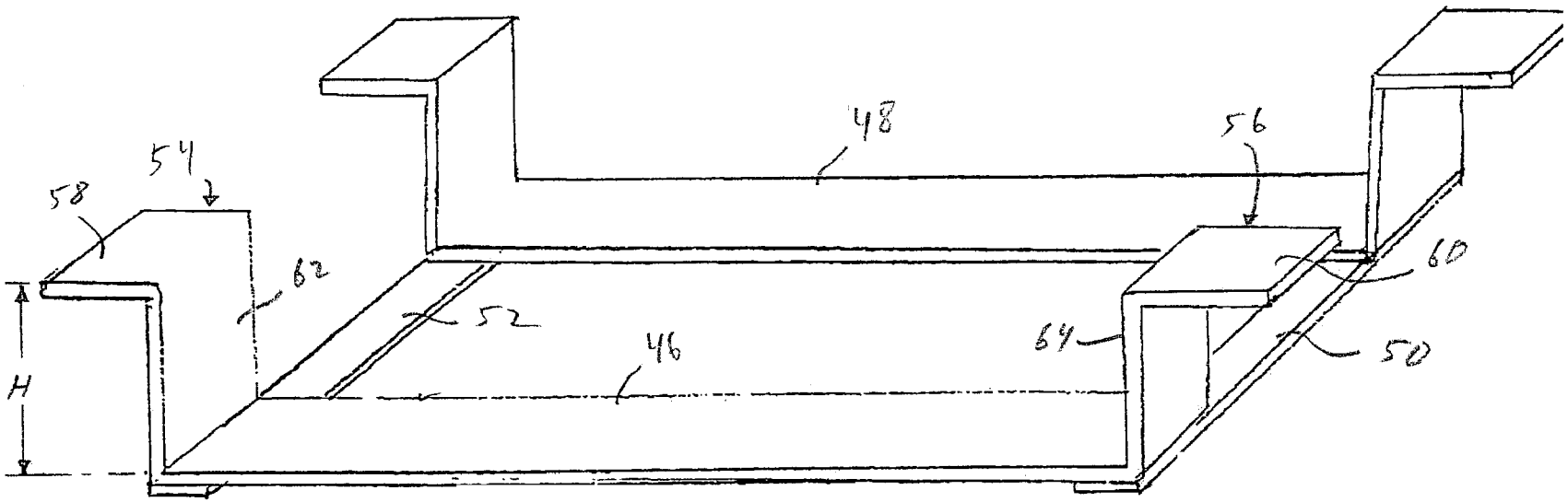
FIG. 3 is a perspective view to an enlarged scale of the bracket system shown in FIG. 1.

Upwardly extending plates 62 and 64 are sized in length so that there is a predetermined height H (FIG. 3) between the top surface of horizontal section 58 and the top surface of beam 44. This top surface of the beam in turn supports and therefore defines the position of the bottom of cap 44. This height H is sufficient to hold cap 44 below the bottom surface 66 of lid 22 at the horizontal attitude and position shown in FIG. 1 where the antenna is at an optimum distance below the lid. At this distance the antenna radiates an RF signal transmission that is optimum for being picked up by a remote receiver. The height H is also sufficiently small to disable unit 38 from floating above and away from the beams in the event the pit becomes flooded with water. For these purposes height H is in the range of 0.5 inches to 3.0 inches, and preferably 1.5 inches.

With bracket 12 thereby securely and indefinitely holding cap 44 in a horizontal attitude at this height relationship, the RF signal beam direction will radiate up at an angle, in the range of 10° to 90°, from horizontal and out the meter box toward any awaiting remote receiver. The height H also brings the antenna sufficiently close to the box lid so that a significant portion of the beam escapes outwardly from between the juncture between the box lid 22 and wall 18. The invention in use has been shown to increase the normal RF transmission range of about 25' in a conventional remote-reading meter to about 150'. This increased range results in fewer missed or misread meter readings, and also enables the meter reading person or mobile unit to take the reading at a greater distance, thereby increasing versatility of the data reading operation. In addition, this antenna position is optimum for receiving signals from a remote receiver which activate the unit 38 to begin data transmissions.

Figure 4:
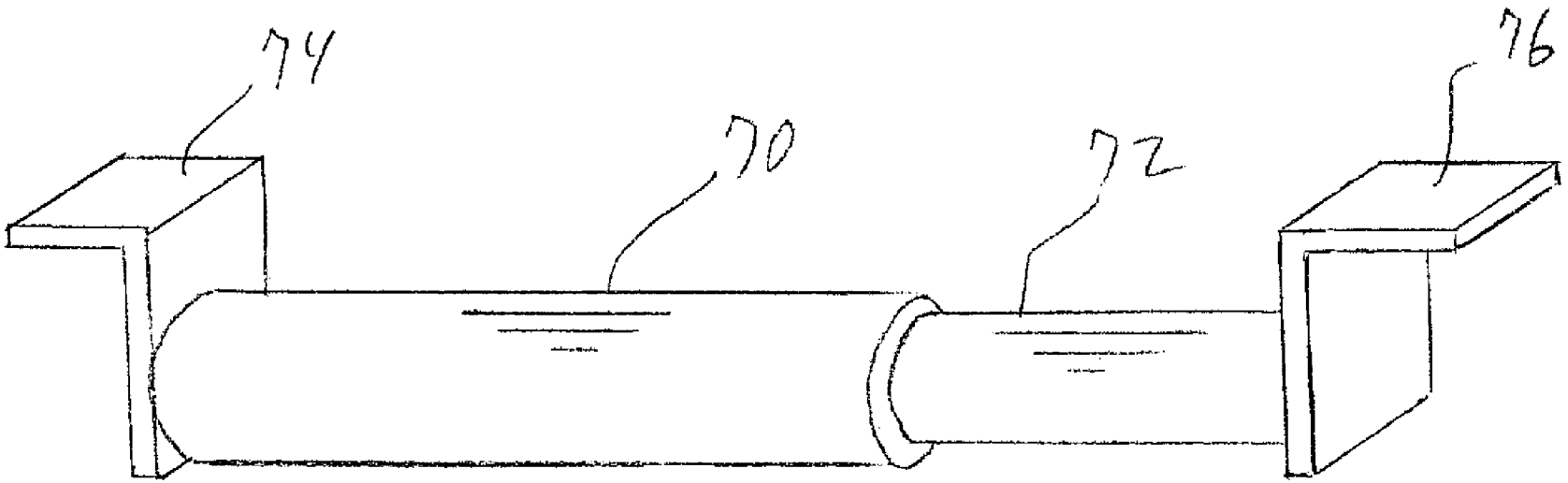
FIG. 4 is a perspective view of a pair of telescoping tube beams which are components of another embodiment.

In another embodiment shown in FIG. 4, each of the beams of the bracket system are comprised of a pair of sets (only one is shown) of telescoping tubes or flat braces comprising tube 70 slidably interfitted about a smaller diameter tube 72. Adjacent tubes of the two sets are joined by cross braces, not shown. Right angles 74 and 76 are secured as by welding to the tube distal ends. These telescoping tubes would replace the beams of the bracket system of the embodiment of FIGS. 1-3. The telescoping tubes enable a universal bracket system which can be fitted into a range of meter box sizes. At the installation site, the worker would need only adjust each telescoping tube set to the required length for fitment with the long inner dimension of the meter box.

While the foregoing embodiments are at present considered to be preferred it is understood that numerous variations and modifications may be made therein by those skilled in the art. Therefore, persons of ordinary skill in this field are to understand that all such variations and modifications and equivalent structures are to be included within the scone of the following claims.

The invention claimed is:

1. A bracket system for use with a meter box which contains a remote-reading water meter comprising a transponder and an antenna for transmitting RF signals to a remote receiver, the meter box having a peripheral ledge that defines an access opening together with a lid that is supported in seated relationship above the ledge, the bracket system comprising a support beam for supporting the unit below the lid and a suspension structure for positioning the unit in captured relationship between the lid and ledge, the suspension structure being connected with the support beam for holding the unit at a vertical height H below the lid which is sufficient to hold the antenna at an optimum position for radiating RF signals for pick up by the remote receiver, wherein the height is further sufficient to disable the unit from unintended dislodgement from the captured relationship.

2. A bracket system as in claim 1 in which the suspension structure comprises an outwardly extending plate joined with an upwardly extending plate, the outwardly extending plate being captured between the ledge and lid.

3. A bracket system as in claim 1 in which the height H is in the range of 0.5 inches to 3.0 inches.

4. A bracket system as in claim 1 in which the bracket system comprises support carried by the suspension structure characterized by a length L which is sufficient to support opposite sides of the unit, the length L being sufficiently large to enable fitment of the unit between the beams.

5. A bracket system as in claim 1 in which the support comprises a pair of tubes mounted together in adjustable telescoping relationship to enable mounting the beam in meter boxes having a range of sizes of access openings.

6. A method of mounting a transponder and antenna unit in a meter box which contains a remote-reading water meter and in which the box has a peripheral ledge that defines an access opening which is covered by a lid, the method comprising the steps of providing a support beam within the box below the lid, supporting the unit on the beam, suspending the support from the ledge and positioning the antenna at a vertical height H below the lid which is optimum for transmitting RF signals to a remote receiver.

7. A method as in claim 6 in which the height H is in the range of 0.5 inches to 3.0 inches.

8. In a meter box containing a remote-reading water meter comprising a transponder and an antenna for transmitting RF signals to a remote receiver, the meter box having a peripheral ledge that defines an access opening, and a lid supported on the ledge, the improvement comprising: a bracket system supportably mounted on the ledge for holding the remote-reading water meter at a predetermined height within the meter box such that the transponder is protected from water entering the meter box, and the antenna is optimally positioned for radiating RF signal data to the remote receiver.

9. A bracket for supporting, in a meter box, a remote-reading water meter comprising a transponder and an antenna for transmitting RF signal data to a remote receiver, the meter box having a peripheral ledge defining an access opening, and a lid supported on the ledge, the bracket comprising first and second suspension structures supported on opposite sides of the ledge, a portion between the suspension structures being configured for holding the remote-reading water meter at a predetermined height in the meter box such that the transponder is protected from water entering the box and the antenna is optimally positioned for radiating the RF signal data to the remote receiver.

10. In a meter box for holding a remote-reading water meter, the water meter comprising a transponder and antenna for transmitting RF signal date to a remote receiver, the meter box defining an access opening surrounded by a peripheral ledge for receiving a lid, the improvement comprising a bracket having opposed ends for resting on opposite sides of the peripheral ledge, and having a portion between the opposed ends for holding the water meter at a predetermined height below the lid such that the antenna is held at an optimum position for radiating RF signal data to the remote receiver, and the height is sufficient to hold the water meter above water entering the meter box.

* * * * *